US007040370B2

(12) United States Patent
Miller

(10) Patent No.: US 7,040,370 B2
(45) Date of Patent: May 9, 2006

(54) HAND TOOL FOR HOLDING A TAPE SPOOL

(76) Inventor: Stephen M. Miller, 935 Radnor Rd., Wilmington, NC (US) 28409

( * ) Notice: Subject to any disclaimer, the term of this patent is extended or adjusted under 35 U.S.C. 154(b) by 0 days.

(21) Appl. No.: 10/827,822

(22) Filed: Apr. 20, 2004

(65) Prior Publication Data

US 2005/0230057 A1 Oct. 20, 2005

(51) Int. Cl.
*B32B 37/00* (2006.01)

(52) U.S. Cl. ..... 156/577; 156/579; 242/405.3; 242/588.2; 242/608.6

(58) Field of Classification Search ..... 156/574, 156/577, 579; 242/405, 405.1, 405.3, 588, 242/588.2, 608.6
See application file for complete search history.

(56) References Cited

U.S. PATENT DOCUMENTS 4,012,273 A 3/1977 Inka
4,026,748 A 5/1977 Wise et al.
4,172,567 A * 10/1979 Post ..... 242/396.7
4,248,392 A * 2/1981 Parry ..... 242/422.1
4,542,863 A 9/1985 Larson
4,706,442 A * 11/1987 Riemenschneider ..... 53/556
4,834,312 A * 5/1989 Riemenschneider, III ..... 242/588.2
5,186,411 A * 2/1993 Fanning et al. ..... 242/405.3
5,328,543 A * 7/1994 Campagna ..... 156/574
5,403,430 A * 4/1995 Araujo et al. ..... 156/523
5,453,152 A * 9/1995 Mazzola et al. ..... 156/577
5,573,630 A * 11/1996 Edney et al. ..... 156/577
5,664,739 A * 9/1997 Black et al. ..... 242/588.2
5,868,334 A * 2/1999 Cedillo ..... 242/405.3
6,102,323 A * 8/2000 Riemenschneider ..... 242/422.4
6,241,176 B1 * 6/2001 McEntee ..... 242/405.3
6,398,619 B1 * 6/2002 Webb ..... 446/475
6,547,177 B1 4/2003 Fitzpatrick
6,688,607 B1 2/2004 Casey et al.

* cited by examiner

*Primary Examiner*—James Sells
(74) *Attorney, Agent, or Firm*—MacCord Mason PLLC

(57) ABSTRACT

Spools of tape are carried on a hand tool that facilitates wrapping of the tape about the threaded end of a pipe while maintaining proper tension on the tape. The tool is designed to carry a spool that has a tubular core with a core longitudinal axis and opposed edges, spaced annular inner and outer side walls attached to opposed edges of the core longitudinal axis, and tape wound around the core between the side walls. The hand tool includes an elongated handle and a spool carrier attached to the one end of the handle for rotatably supporting a spool of tape. When used, the tool is orbited around the pipe end, with tension on the tape achieved by thumb pressure against the spool side wall to retard spool rotation.

5 Claims, 1 Drawing Sheet

HAND TOOL FOR HOLDING A TAPE SPOOL

BACKGROUND OF THE INVENTION (1) Field of the Invention

The present invention relates to a hand tool for holding a spool of tape of the type used to wrap the threaded ends of pipe, and in particular to a hand tool useful in the uniform application of tape to threaded pipe ends.

(2) Description of the Prior Art

Leakage at pipe joints, such as the joints of plumbing pipe, irrigation pipe, etc., is prevented by wrapping tape such as polytetrafluoroethylene or Teflon tape around the threaded end of the male pipe section before joinder of the male and female sections. Tape for this use is sold on a metal or plastic spool and is normally applied to pipe threads by inserting a finger into the spool core and rotating the spool around the pipe end.

During application, the spool may slip from the user's hand, resulting in unwinding of the tape from the spool. In addition, it is difficult to apply the proper tension to the tape and properly locate the tape around the pipe end while attempting to rotate the spool and simultaneously release the tape at an appropriate rate from the spool. Therefore, there remains a need for an improved tool for dispensing tape during wrapping of the threaded ends of pipes, which will permit uniform application of the tape at a desired tension without the risk of dropping the tape.

SUMMARY OF THE INVENTION

The present invention is directed to a hand tool useful in supporting a spool of tape used during wrapping of the tape around the threaded end of a pipe. More specifically, the present hand tool is designed to support a spool comprised of a tubular, cylindrical core and spaced annular, parallel side walls attached to the core edges transverse to the core longitudinal axis. Tape is wound around the core between the side walls.

The hand tool is comprised of an elongated handle of sufficient length and diameter to be comfortably gripped by the user. The handle will normally have a circular cross-section, although other cross-sections are within the scope of the present invention.

The handle length is approximately equal to or slightly longer than the width of the average user's hand, i.e., from about 3 to 5 inches.

A spool carrier is attached to one end of the handle to rotatably support a tape spool with the longitudinal axis of the spool core being parallel to the longitudinal axis of the handle. Preferably, the longitudinal axes of the spool core and the handle are aligned so that the spool carrier projects outwardly from the end of the handle.

The spool carrier can be constructed in various ways, so long as two requirements are met. First, the spool must be freely rotatable on the carrier so that the spool will rotate when the tape end is pulled. Second, tape must be positioned on the carrier relative to the handle so that the user can apply pressure with his or her thumb against the side of the spool wall that is toward the handle to retard rotation of the spool. By retarding spool rotation, tape overrun can be avoided and proper tension on the tape can be applied to firmly affix the tape about the pipe threads.

Means should be provided for preventing the spool from sliding off of the carrier while tape is being unwound. For example, the tool can include a spool retainer such as an annular flange around the tool handle adjacent the end of the handle that is attached to the carrier to prevent the spool from slipping onto the handle. The spool carrier can also include a retainer at its outer end to prevent the spool from slipping off of the carrier.

As will be described in detail hereinafter, a preferred spool carrier is compressible, so that the spool can be slipped onto or off of the carrier when the carrier is radially compressed, but held securely but rotatably on the carrier when the compression is released. For example, the carrier can be constructed of a plurality of radially aligned sections, i.e., sections arranged in a circle about the carrier longitudinal axis, that are radial compressible. The sections may include outwardly extending projections on their outer ends, with the diameter of the outer ends of the projections being such that the diameter of the projections is less than the diameter of the spool core when the carrier is compressed, but greater than the diameter of the spool core when the compression is released.

Other spool carrier configurations meeting the above requirements will be apparent to one skilled in the art upon reading the present specification. For example, the spool carrier can be comprised of a cylindrical spool support having a diameter less than the inner diameter of the spool core and a removable cap attached to the outer end of the spool support, with the cap having a diameter greater than the inner diameter of the spool core. A retainer on the handle-side of the spool support can be included to prevent the spool from sliding onto the handle.

Tape used to wrap pipe is sold in various widths, and the size of spools used to carry the tape vary accordingly. For example, the tape may be 0.5, 0.75 or 1.0 inch in width. As a result, core dimensions, i.e., the core length and/or the core diameter of the spools, may differ depending on the tape purchased. Tape spools with different core dimension require spool carriers with different dimensions. In order to avoid the necessity of a different tool for each tape spool size, it is also within the scope of the invention to provide a tool comprised of a handle having opposed first and second ends, a first spool carrier sized for a spool with given core dimensions at one end of the handle, and a second spool carrier sized for a spool with core dimensions different from the given core dimensions at the other end of the handle.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
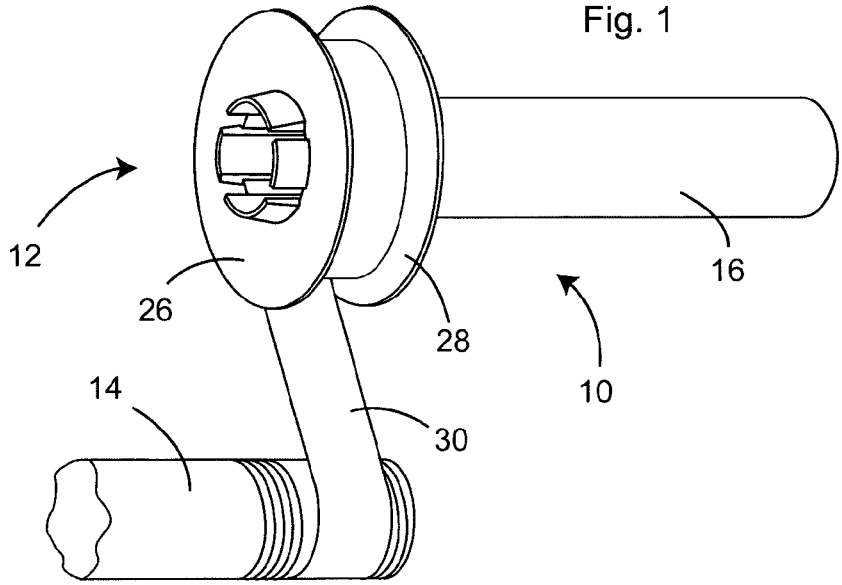
FIG. 1 is a perspective view of a preferred hand tool shown supporting a spool of tape that is being wrapped around the threaded end of a pipe.
Figure 2:
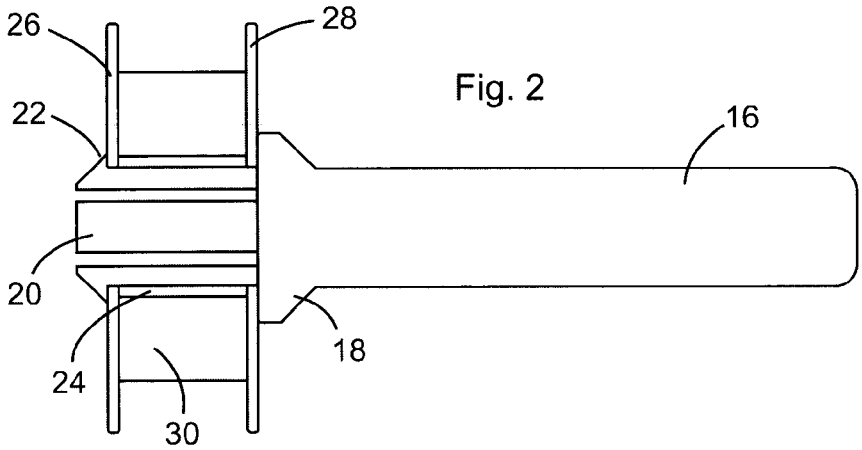
FIG. 2 is a sectional side view of a preferred hand tool supporting a spool of tape.

As best shown in FIGS. 1 and 2, the preferred hand tool, generally 10, is shown supporting a tape spool, generally, 12, being used to wind tape onto a threaded pipe 14. Tool 10 is comprised of a cylindrical elongated handle 16 having an annular retainer 18 adjacent its distal end. A spool carrier comprised of a plurality of circularly arrayed sections 20 with radially extending flanges 22 at their outer ends attached to the distal end of handle 16. Tape spool 12 is comprised of a cylindrical core 24 axially aligned with handle 16, and a pair of spaced, parallel annular walls 26 and 28 attached to the outer ends of core 24 to form an annular recess for a roll of tape 30.

When used, spool 12 is inserted onto the spool carrier by compressing sections 20. Once inserted, spool 12 is freely rotatable on the carrier. The end of tape 30 is then pulled from spool 12 and wrapped partly around the threads of pipe 14. Tool 10 is then moved in an orbital path around the threaded end of pipe 14 with spool 12 being in a plane with the threads until the desired amount of tape has been wrapped around the pipe. Tape 30 is then cut or torn. During wrapping of tape 30, the user maintains pressure against the handle side of wall 28 with the side of his or her thumb sufficient to prevent tape overrun and to place tension on tape 30 so that tape 30 will be tightly wrapped around the threads of pipe 14.

Figure 3:
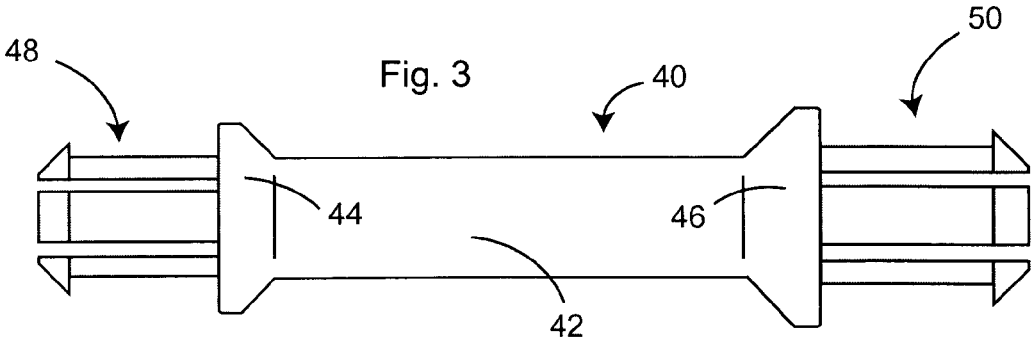
FIG. 3 is a side view of an alternative hand tool.

In the alternative embodiment shown in FIG. 3, tool, generally 40, is comprised of a central handle 42 with annular flanged retainers 44 and 46 at its opposed ends. A first spool carrier 48 is axially aligned with handle 42 at one end and a second spool carrier 50 axially aligned at the opposite end. Carrier 48 is sized to hold a tape spool having a given core dimension, while carrier 50 is sized to hold a tape spool having a larger core dimension. Thus, tool 40 can be used to hold either of two tape sizes, or two spools of different sizes at the same time. Tool 40 is used in the same manner as tool 10.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A hand tool for holding first and second spools of tape used to wrap the threaded end of a pipe, each of said spools comprising a tubular core with a core longitudinal axis and opposed edges, spaced annular inner and outer side walls attached to said opposed edges transverse to said core longitudinal axis, and tape wound around said core between said side walls, said tool comprising:

a) an elongated handle having a opposed first and second ends and a handle longitudinal axis, said handle including spool retainers adjacent its first and second ends to prevent said first and second spools from sliding onto said handle;

b) a first spool carrier with a first diameter attached to the first end of said handle for rotatably supporting a first spool of tape with given core dimensions with the first spool core longitudinal axis aligned with said handle longitudinal axis, said first spool carrier including an outer retainer to hold said spool onto said roll support; and c) a second spool carrier with a second diameter different from said first diameter attached to the second end of said handle for rotatably supporting a second spool of tape having core dimensions different from said given core dimensions with the second spool core longitudinal axis aligned with said handle longitudinal axis, said second spool carrier including an outer retainer to hold said spool onto said roll support, said first and second spool carriers having cylindrical outer walls formed of a plurality of radially aligned, spaced sections having inner ends attached to said handle and free outer ends, said outer ends including outwardly extending spool retainer flanges.

2. A device for wrapping tape around the threaded end of a pipe comprising, in combination as a kit:

a) a first spool having a tubular core with a core longitudinal axis and opposed edges, spaced annular, parallel inner and outer side walls attached to said opposed edges transverse to said core longitudinal axis, and pipe wrapping tape wound around said core between said side walls; and b) a hand tool for supporting said spool so that said spool is freely rotatable on said spool carrier, said tool including i) an elongated handle with a first end, a handle longitudinal axis, and an inner retainer adjacent its first end to prevent said spool from sliding onto said handle; and ii) a spool carrier attached to the first end of said handle, said carrier being insertable into said spool tubular core for rotatably supporting said spool with said core longitudinal axis being aligned with said handle longitudinal axis, whereby said handle can be gripped by a user with rotation of said spool being controllable by the pressure of the user's thumb against said inner side wall, wherein said spool carrier has a cylindrical outer wall formed of a plurality of radially aligned, spaced sections having inner ends attached to said handle and free outer ends, said outer ends including outwardly extending flanges to hold said spool onto said spool carrier.

3. The device of claim 2, wherein said handle is cylindrical.

4. The device of claim 2, wherein said handle includes a second end, said tool further including a second spool carrier attached to the second end of said handle, and a second spool rotatable on said second spool carrier.

5. The device of claim 4, wherein said first and second spool carrier are adapted to support spools with different core dimensions, and said first and second spools have different core dimensions.

* * * * *